US005921899A

United States Patent [19]

Rose

[11] Patent Number: 5,921,899

[45] Date of Patent: Jul. 13, 1999

[54] PNEUMATIC EXERCISER

[76] Inventor: Amelia T. Rose, 11 Woodlot Rd., New Paltz, N.Y. 12561

[21] Appl. No.: 09/020,597

[22] Filed: Feb. 4, 1998

[51] Int. Cl.[6] ..... A63B 21/008

[52] U.S. Cl. ..... 482/112; 482/77

[58] Field of Search ..... 482/77, 111, 112, 482/113, 146

[56] References Cited

U.S. PATENT DOCUMENTS

| | | | |
|---|---|---|---|
| 1,617,665 | 2/1927 | Cashoty . | |
| 2,096,310 | 10/1937 | Schauweker . | |
| 3,110,492 | 11/1963 | Hoffmeister . | |
| 3,116,061 | 12/1963 | Gaberson . | |
| 3,915,451 | 10/1975 | Adams et al. . | |
| 4,645,197 | 2/1987 | McFee . | |
| 5,009,415 | 4/1991 | Perez Blanco . | |
| 5,071,115 | 12/1991 | Welch . | |
| 5,112,045 | 5/1992 | Mason et al. | 482/77 |
| 5,129,873 | 7/1992 | Henderson et al. . | |
| 5,242,340 | 9/1993 | Jerome . | |

*Primary Examiner*—Richard J. Apley
*Assistant Examiner*—William LaMarca
*Attorney, Agent, or Firm*—Sandra M. Kotin

[57] ABSTRACT

An exercise apparatus that a user can utilize when alone and which imitates the motion of a trampoline and can also imitate the motion of jumping rope while providing secure support to the user. A horizontal platform is supported on a base that has pivotally connected crossed arms that permit the platform to smoothly move up and down. The resistance is provided by a pneumatic spring assembly located beneath the platform. Compressed air supplied by a simple tire pump and a relief valve enable the user to increase or reduce the pressure of the system, thus controlling the bounce frequency and degree of resistance. A pressure set-up table assists the user in setting the pressure at the proper level for his or her needs and an ergometer accurately determines energy output. A handlebar assembly attached to the platform provides good support and can be vertically adjusted to accommodate the particular support needs of the user.

19 Claims, 6 Drawing Sheets

| WEIGHT (POUNDS) | FREQ. (Hz) 1.5 | 2.0 | 3.0 |
|---|---|---|---|
| 60 | 8 | 11 | 19 |
| 80 | 9 | 13 | 22 |
| ... | ... | ... | ... |
| 120 | 11 | 16 | 28 |
| ... | ... | ... | ... |
| 200 | 15 | 22 | 35 |
| ... | ... | ... | ... |

PNEUMATIC EXERCISER

FIELD OF THE INVENTION

The instant invention relates to a rehabilitative and exercise device that mimics the motion of a trampoline and utilizes an adjustable pneumatic system to provide the resistance.

BACKGROUND OF THE INVENTION

It has long been known that prescribed exercises are valuable to rehabilitate injured and surgically reconstructed muscles, tendons and other tissues and to improve cardiovascular performance. A variety of mechanical devices have been developed and used by therapists to supplement the exercises. The health and fitness-conscious have also developed devices to improve muscle tone, body shape and athletic performance and some of these devices have also been employed in rehabilitation programs after injury and/or surgery. Often the goal of the various devices has been to increase the enjoyment level of the exercise in the hope that the length of the exercise period would be increased.

Early devices were often designed to enable the user to move forward by simulating a jumping motion. Cashoty teaches a device designed for use by children whereby the user stands on a platform supported by legs attached to support posts by leaf springs. The user holds the upper portions of the support posts and jumps up and down on the platform ultimately advancing forward as he jumps. (U.S. Pat. No. 1,617,665) A similar device in the form of a stilt on wheels is taught by Schauweker in U.S. Pat. No. 2,096,310. The platform of this device is for one foot, so two stilts must be mounted at the same time. Hoffmeister, in U.S. Pat. No. 3,110,492, developed jumping stilts that did not move on wheels but left the ground as the user jumped up and down. Gaberson discloses the pogo stick-like exerciser where there are two footrests affixed to a single pole that is spring activated to propel the user up and down as the pole moves forward. (U.S. Pat. No. 3,116,061) Adams, et al. teaches a stationary pogo stick for children in U.S. Pat. No. 3,915,451. A bouncing motion was achieved by literaly sitting on a bouncing ball held in a framework with handle bars in the device of Perez Blanco. (U.S. Pat. No. 5,009,415)

More recently exercise devices began to imitate the same motion as climbing a flight of stairs. These exercisers were developed to provide enhanced aerobic benefits as well as build muscle mass and strength. In all of these exercisers, the handlebars or other support system are external to the platform or steps and are stationary while the user moves up and down. Such devices utilized hydraulic cylinders (U.S. Pat. No. 5,071,115 to Welch); elastomeric torsion springs (U.S. Pat. No. 5,129,873 to Hendersen et al.); and a sprocket and chain used to turn a drum with tension adjustable by cord and bias springs (U.S. Pat. No. 5,242,340 to Jerome).

McFee, in U.S. Pat. No. 4,645,197, designed a board exerciser that can be adjusted according to the weight of the user who stands on a platform and holds movable handles. The platform is made to oscillate by flexing the knees and exerting pressure on a handle. Elastic springs or compressed coil springs are employed.

None of aforementioned devices provide support to the user such that a post-surgical patient, an older person or one with infirmities can safely and beneficially utilize them. There is a need for an exercise device that is completely adjustable to the requirements of the user, that safely supports the user, and that provides exercise and rehabilitative benefits atttained from motions ranging from merely flexing the knees to full jumping capabilities.

BRIEF SUMMARY OF THE INVENTION

The present invention provides a rehabilitative and exercise device consisting of a horizontal platform supported on a flexible frame that permits vertical motion only. There is an adjustable handlebar assembly mounted directly on the platform. A unique pneumatic spring assembly provides the resistance and return in a smooth and controlled manner that enables the user to utilize the device with confidence at the outset, thus encouraging repeated and prolonged sessions.

The use of the pneumatic spring assembly, and more specifically the air spring, presents many advantages such as low collapsible height, easy adjustability, and the ability to measure internal pressure. These attributes, in turn, provide the tuning capability for the user's weight and desired bouncing frequency and also provide low step-up height. The air spring also supports the use of an accurate and inexpensive ergometer. The platform is constrained to move vertically and to remain horizontal during the entire excursion. This behavior minimizes the balancing requirements of the user which are further minizimed by the platform-mounted handlebar assembly which moves with the platform and is therefore always at the same attitude with respect to the user.

It is an object of the present invention to provide low impact exercise equipment for rehabilitation of patients with cardiac or diabetic problems, for post surgical rehabilitation of knee, leg and ankle muscles and tendons, for the exercise needs of the elderly and those with balancing problems, as well as for general exercise enjoyment.

A further object of the present invention is to provide a safe apparatus for the user to experience bouncing activity similar to jumping on a trampoline or jumping rope, but without the need for superior balancing skills.

Another object of the present invention is to provide exercise equipment that can be tuned to the weight of the user and to his or her desired bouncing frequency.

Yet a further object of this invention is to provide a simple method of performing the tuning process prior to the start of an exercise session.

A still further object of this invention is to make changing the tuning during an exercise session simple enough for the user to accomplish when alone.

Another object of the present invention is to provide a stable platform, an adjustable support bar system mounted on the platform, and a low step-up height for mounting.

A further object of this invention is to provide an apparatus that can be transported and that can be stored in a small space.

A further object of this invention is to provide a method to characterize the energy requirements of the apparatus, in a factory setting, for different modes of use.

Yet another object of this invention is to use the factory energy characterization with an inexpensive ergometer system to provide accurate estimates of calories output by the user in performing the exercise.

A still further object of the present invention is to provide an action modality that requires virtually no maintenance and long term performance.

Other features and advantages of the invention will be seen from the following description and drawings.

DETAILED DESCRIPTION OF THE INVENTION

Figure 1:
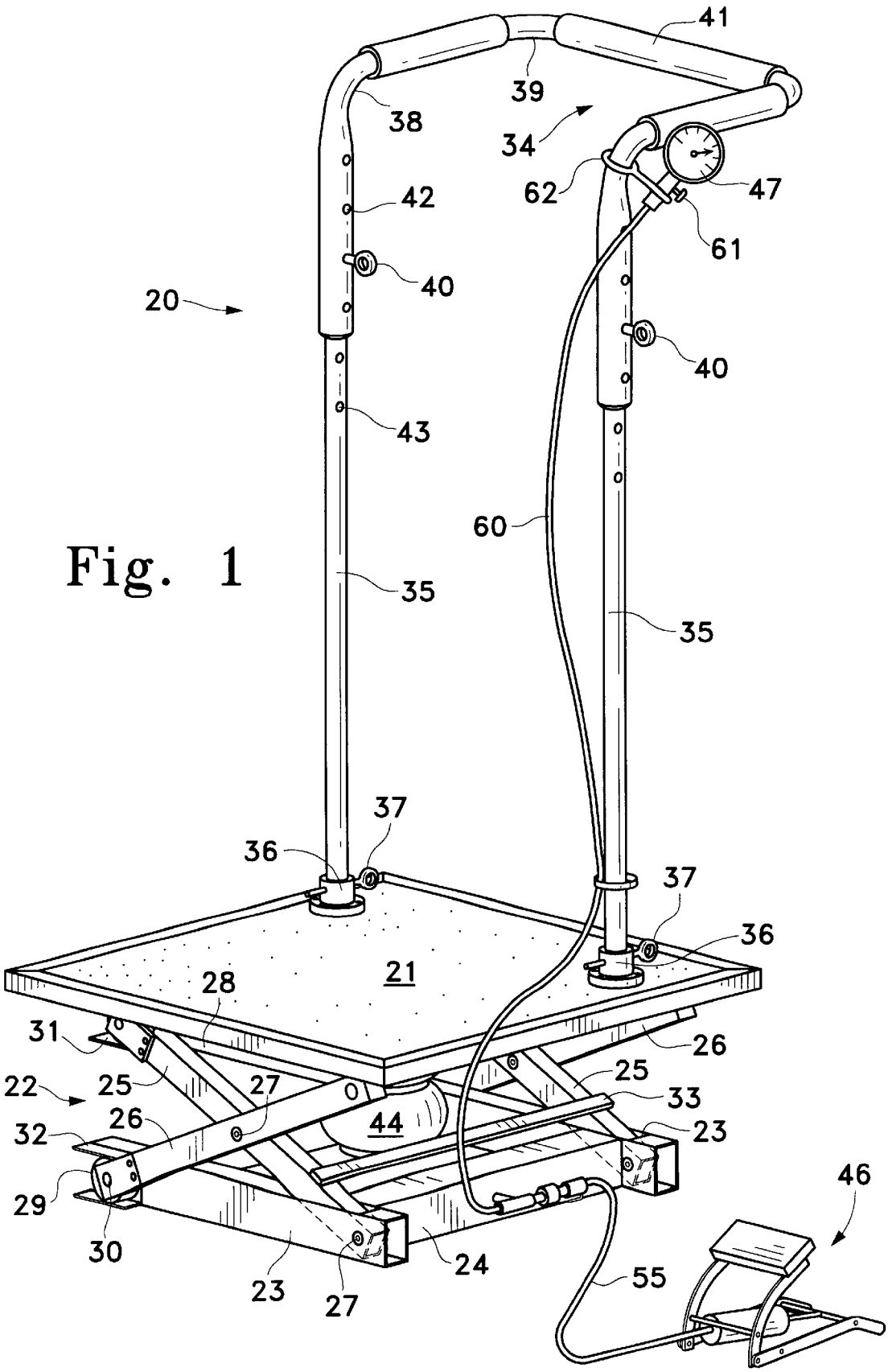
FIG. 1 is a rear perspective view of the pneumatic exerciser.
Figure 3:
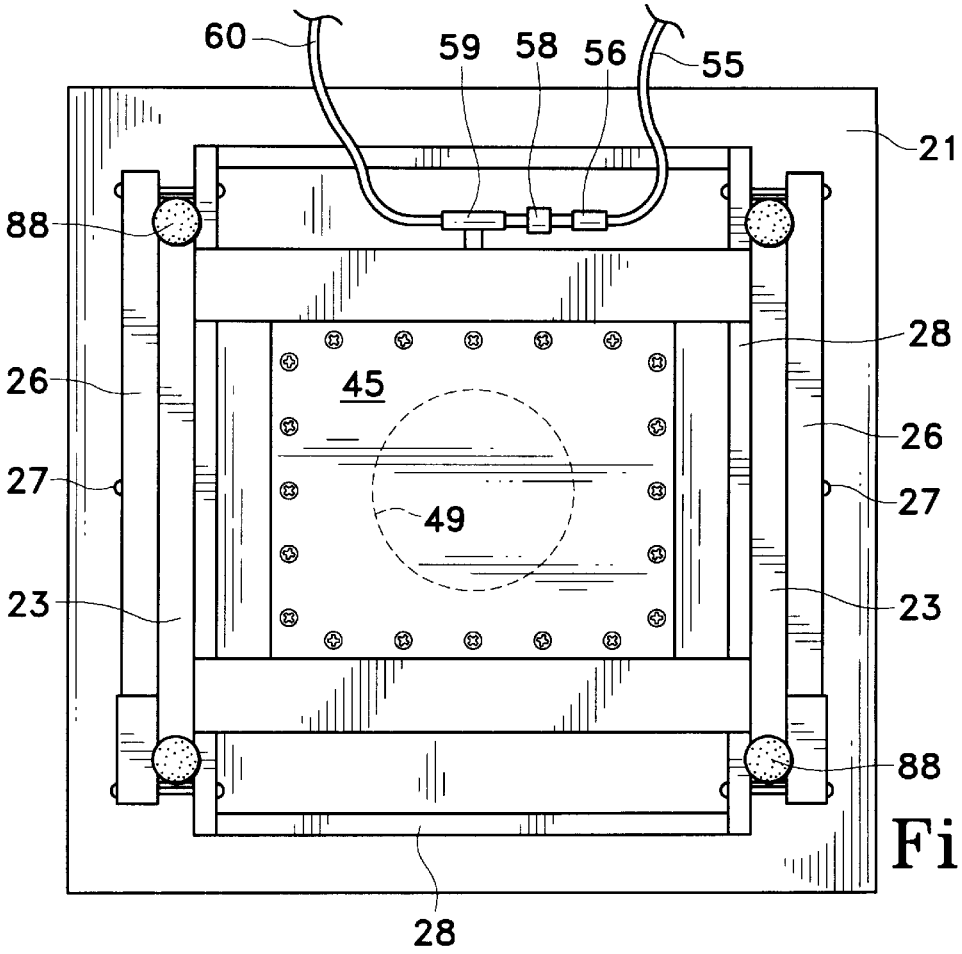
FIG. 3 is a bottom plan view of the pneumatic exerciser showing the air chamber.

The pneumatic excerciser 20 is seen in FIG. 1. A horizontal platform 21 is permanently mounted on a support system 22 that is quite strong yet permits the platform 21 to move in a smooth vertical motion without extraneous vibrations or unwanted slippage and to remain horizontal throughout the exercise workout. The support system 22 is comprised of rectangular cross section tubing which provides a rigid structure. Four upper support members 28 are affixed to the underside of the platform 21. A sub base of front and rear support members 23 and side support members 24 rests on rubber or nylon coasters 88 seen in FIG. 3 which function as dampers and prevent the exerciser 20 from "walking" during use. Crossed arms 25 and 26 pivoted in the center by pivot pins 27 are disposed at the front and rear to maintain the platform 21 in a horizontal configuration and to restrict it to move vertically relative to the sub base. Each arm 25 is connected at one end by a pivot pin 27 to a support member 23 and has a wheel 29 at the other end which rests within and articulates with a bracket 31 situated at the end of a support member 28. Each arm 26 is connected at one end by a pivot pin 27 to a support member 28 and also has a wheel 29 at the other end which articulates with a bracket 32 situated at the end of a support member 23. The wheels are attached to the support members by means of axles 30 which permit the wheels to rotate freely. The brackets 31 and 32 have horizontal slots 81 on the inside walls to accommodate the axles 30. See FIG. 6A. The inside ends of the axles 30 are splayed or fitted with bolt heads to retain them within the slots and restrain the wheels solely to forward and backward motion. The bottom portions of brackets 31 and 32 function as tracks for the wheels. A crossbar 33 extends across the sides of the support system and attaches to both crossed arms 25 binding them rigidly together to minimize any rocking tendency of the platform 21. A pneumatic system with an air spring is located beneath the platform and within the framework of the support system 22.

The slots 81 in brackets 31 and 32 also function as limit stops to prevent the platform from rising beyond the stretch limit of the air spring and from compression beyond its lower design limit. On the downstroke of the platform 21 the wheels 29 move outward and if the pressure in the air spring is low the axles 30 will contact the outside ends of the slots and prevent the platform from falling any lower. On the upstroke, the wheels 29 move inward and if the pressure is high, contact of the axles with the inside ends of the slots 81 will prevent the platform from achieving an excessively high attitude.

Figure 6B:
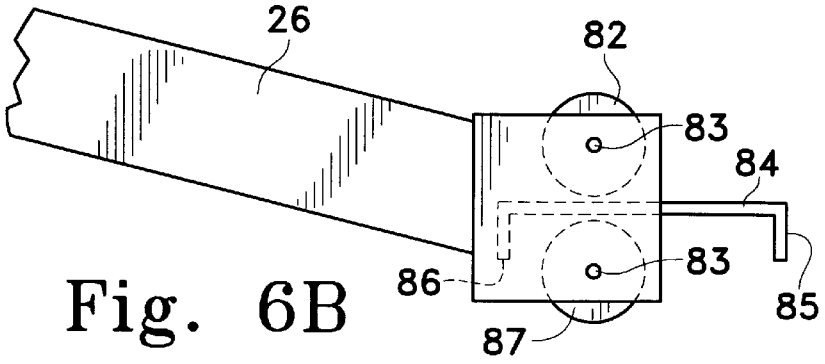
FIG. 6B is a schematic side view detail of the double wheel assembly for the support system.
Figure 6A:
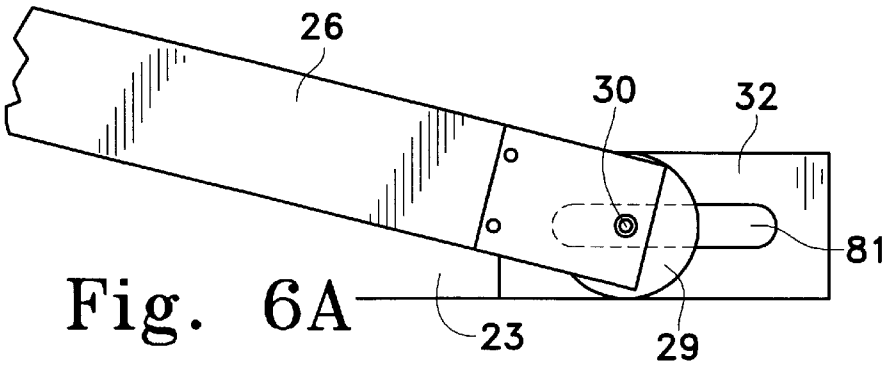
FIG. 6A is a schematic side view detail of the single wheel assembly for the support system.

An alternative to the single wheel assembly described above is to utilize a double wheel assembly at one end of each crossed arm 25 and 26 as illustrated in FIG. 6B. Two wheels 82 and 87 are pivotally attached at one end of each crossed arm, one above the other, by means of axles 83, so they both can rotate freely. Instead of the brackets 31 and 32, riding flanges 84 are affixed to the ends of support members 28 and 23 to articulate with the wheels 82 and 87. The motion of the wheels is restricted by limit stops 85 and 86 at each end of the riding flanges 84. On the downstroke of the platform 21 the upper wheels 82 ride on the riding flanges 84 and continue outward until the compression of the air spring retards further movement or the lower wheels 87 contact the limit stops 85. On the upstroke, the upper wheels 82 will generally remain in contact with the top surfaces of the riding flanges 84 unless an unbalanced force on the platform tends to twist the platform thereby lifting the upper wheels 82 and causing the anti-lift lower wheels 87 to contact the lower surfaces of the riding flanges 84. The double wheel assembly maintains the platform in essentially horizontal orientation at all times. If the pressure in the air spring is high, the lower wheels 87 will contact the limit stop 86 and prevent the platform from reaching beyond the stretch limit of the air spring.

Figure 2:
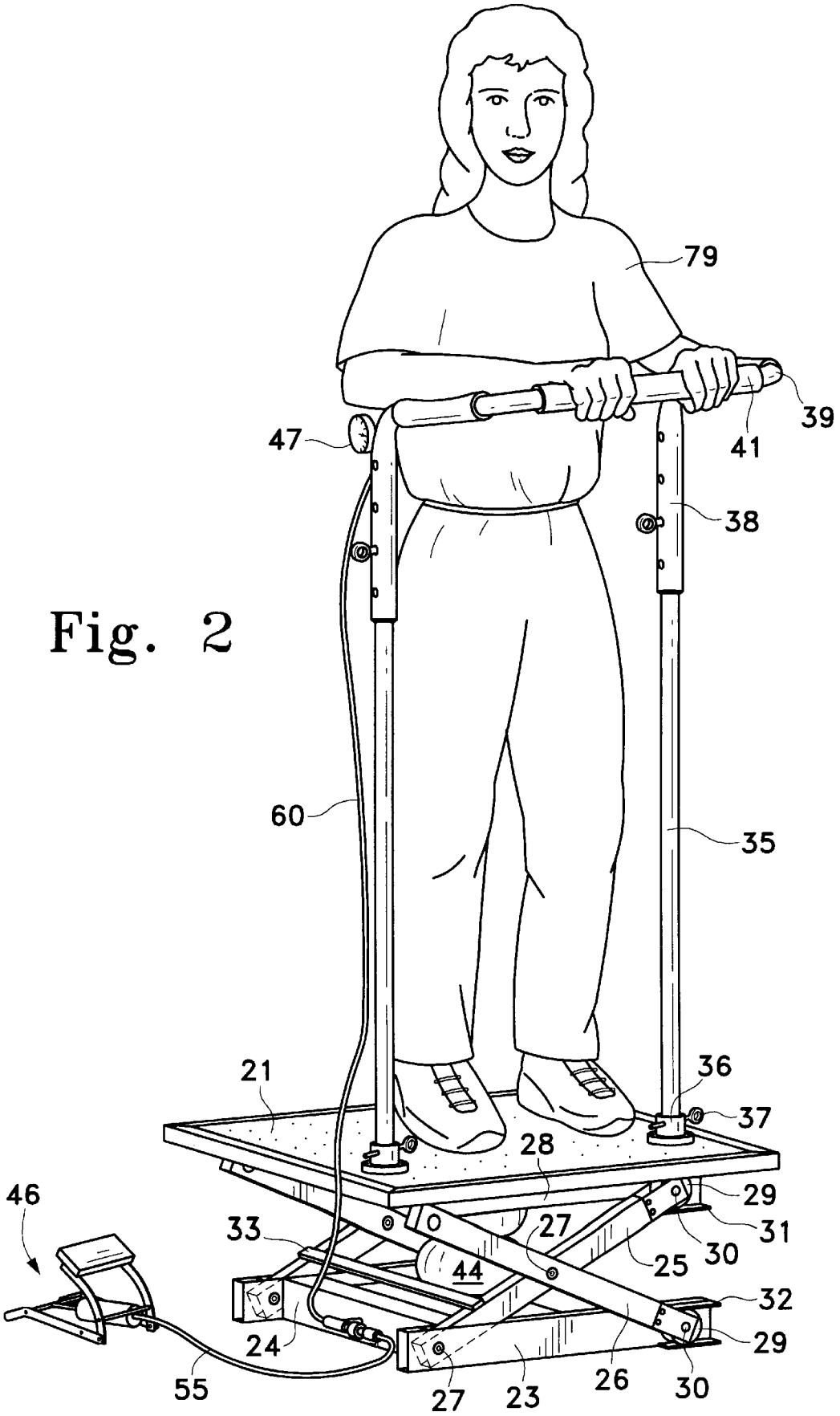
FIG. 2 is a front perspective view of the pneumatic exerciser in use.

The user is supported by a removable handlebar assembly 34 that is retained in sockets 36 attached directly to the platform 21. The handlebar assembly remains fixed with respect to the user, minimizes the balancing requirements of the user and enables the user to remain securely supported during the exercise period to help build confidence and encourage longer work-outs. The handlebar assembly 34 is composed of two uprights 35 which are retained in the sockets 36 by means of spring pins 37. A U-shaped crossbar 39 having right angle extensions 38 at each end fits over the ends of the uprights and enables the crossbar 39 to be set at different levels depending on the height of the user and the degree of support desired. If necessary, the user can rest his or her arms and elbows on the crossbar 39 as seen in FIG. 2. Openings 42 in the extensions correspond to openings 43 in the uprights whereby removable pins 40 set the placement securely. Other height adjusting means known in the art can be employed. Foam grip sleeves 41 are provided to make it easier for the user to hold on to the crossbar 39.

Figures 7, 8:
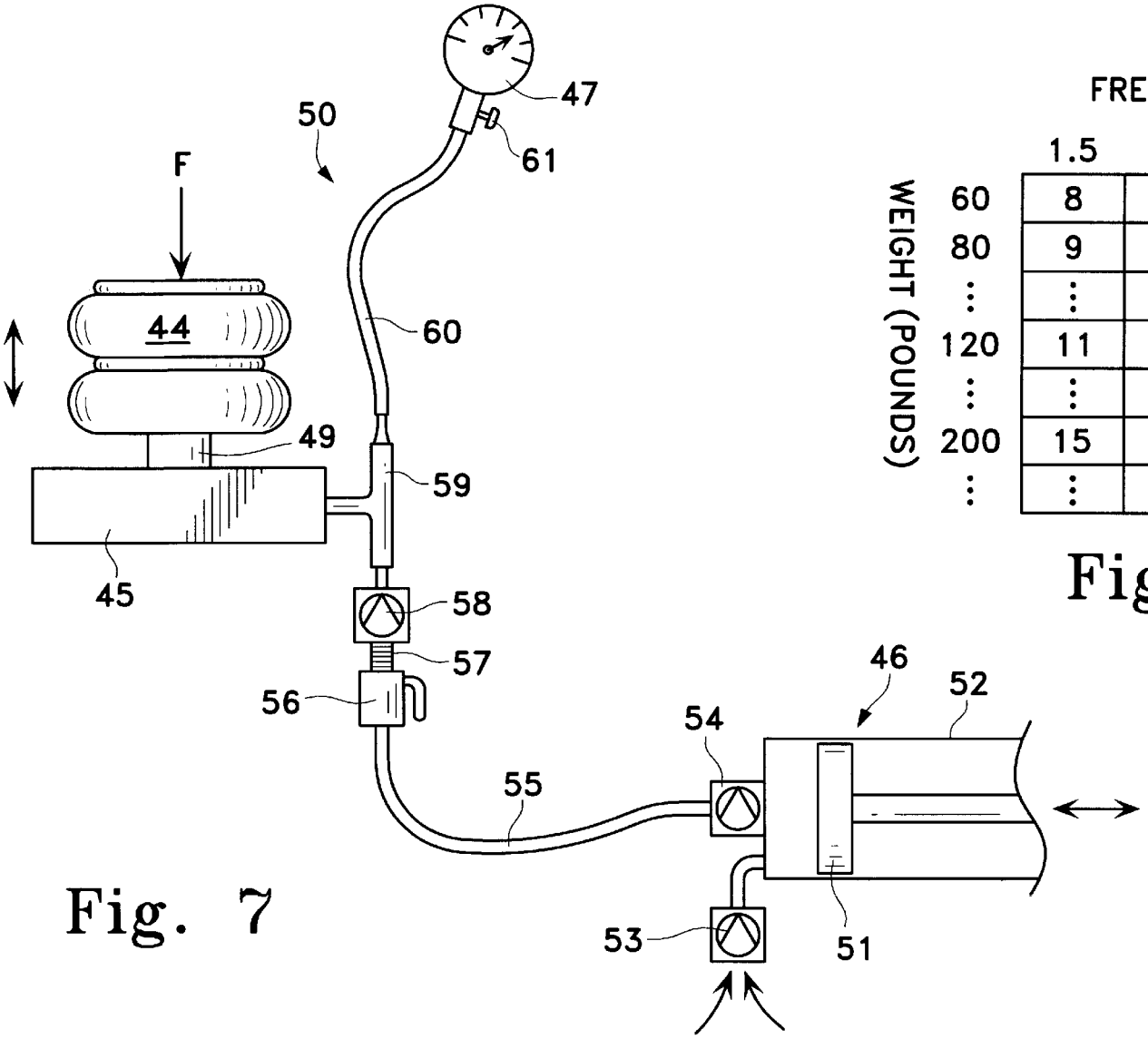
FIG. 7 is a schematic view of the complete pneumatic spring assembly.
FIG. 8 is a pressure set-up table.

The springing action is achieved through a pneumatic spring assembly 50 situated under the platform 21. The pneumatic spring assembly consists of an air spring 44, an air chamber 45, an air compressor or pump 46 and a relief valve 61. A pressure gauge 47 provides a read-out of the pressure within the assembly which is schematically illustrated in FIG. 7.

The air spring 44 is a model 25 Airstroke® Actuator from Firestone Industrial Products Company of Carmel, Ind. It consists of a two convolution reinforced rubber bellows with a mimium height of 2.8 inches (7.1 cm) and a maximum height of 7 inches (17.8 cm). It is designed for use with pressures up to 100 PSIG (pounds per square inch gauge). The Engineering Manual and Design Guide (EMDG 197) from Firestone presents some design formulas and guidelines which are helpful although they do not represent this particular application. The low step-up height made possible by this air spring increases the desirability of the pneumatic exercisor for rehabilitative purposes.

A coil spring for reliable operation of equivalent stroke capability (7−2.8=4.2 inches; 17.8−7.1=10.7 cm) would have to be at least 11 inches (27.9 cm) long. Furthermore, a coil spring supporting desired system resonant frequencies below 2 Hz would require real deflections approaching 7 inches (17.8 cm). Besides the difficulties in providing adjustability for a coil spring system, these factors make a coil spring option undesirable.

Figure 4:
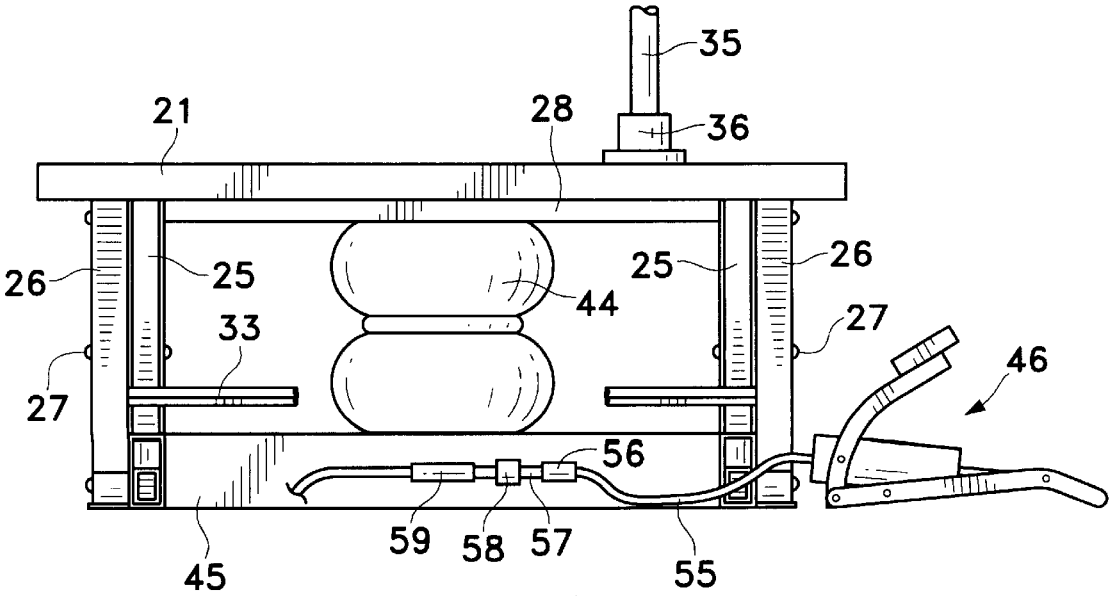
FIG. 4 is a right side elevational view of the pneumatic exerciser showing the air spirng, air chamber and pump
Figure 5:
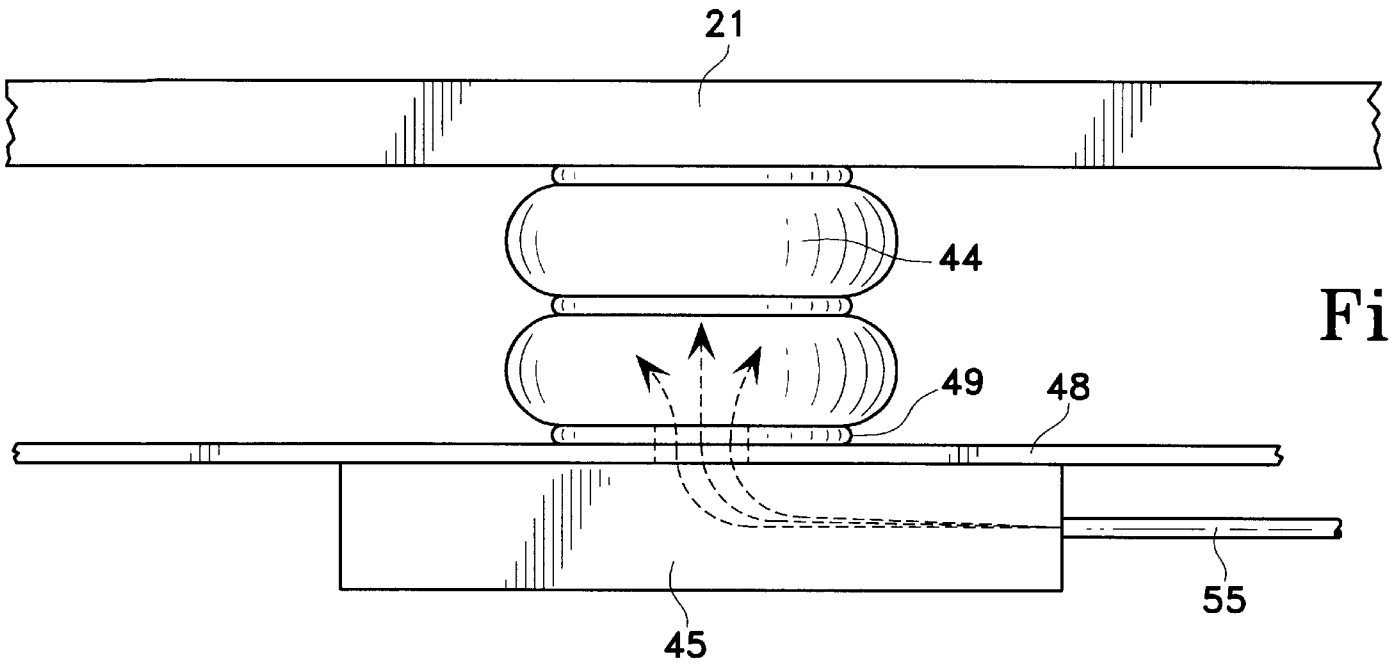
FIG. 5 is a schematic side view of the air spring, bouncing platform and air chamber.

As seen in FIG. 4 the air spring 44 is mounted between the platform 21 and a stationary bottom plate 48 which also forms the top of the air chamber 45. The air chamber 45 is set securely between the front and back support members 23 and the side support members 24 of the sub base. The top of the air spring 44 is directly affixed to the center of the underside of the platform 21 and a large diameter hole coupling 49 connects the bottom of the air spring 44 to the air chamber 45. Air communicates between the air spring and the air chamber through a large sealed circular opening so as to minimize any throttling effects between the air spring and the air chamber. See FIG. 5.

The source of compressed air can be any convenient manual or electric pump. A standard foot operated tire pump, as illustrated in FIG. 7, functions well and can easily be operated by most users, while a manually operated tire pump or electric tire pump can also be used. The pump 46 consists of a piston 51, cylinder 52, inlet check vlave 53, outlet check valve 54, hose 55 and hose coupling 56. A Schraeder valve 57 as commonly found on automobile tires engages with the hose coupling 56 and also communicates with a high quality check valve 58.

If the pump 46 is always removed immediately after each use the high quality check valve 58 would not be necessary since the Schraeder valve 57 would seal the system. If the pump 46 is kept connected for an extended period of time, as with typical usage of exercise devices, the Schraeder valve 57 is kept open and the outlet check valve 54 is required to seal the system. Such valves are notoriously leaky so the high quality check valve 58 seals the system when the pump 46 remains connected. A "T" coupling 59 permits the compressed air from the pump 46 to enter the air chamber 45 and also to reach the pressure gauge 47 via a flexible conduit 60. The pressure gauge 47 has a finger operated relief valve 61 which enables the user to bleed air from the system to reduce the system pressure.

As seen in FIGS. 1 and 2, the pump 46 is set up along side of the pneumatic exerciser 20. Before stepping on the platform the user can pump air into the system or bleed air out of the system as necessary to achieve the desired pressure. The pressure gauge 47 is attached to the crossbar 39 by means of a clip 62 or strips of hook and loop type fastener. This way the gauge is visible to the user and the pressure can be reduced by bleeding the system by means of the relief valve 61 without the user having to leave the platform 21.

Since the pneumatic exerciser can be used after surgery for rehabilitative exercise and by the elderly and the handicapped as well as patients recovering from cardiovascular problems, the handlebar assembly 34 is mounted directly on the platform 21 and is always at the same orientation with respect to the user. The level of support can be determined by the user who can set the height of the crossbar as desired. If necessary, the user can rest his or her entire arms on the crossbar for maximum support as previously described and illustrated in FIG. 2. The user stands on the platform and flexes his or her knees to achieve a trampoline-like motion. The feet do not have to leave the platform. As noted above, the low step-up height which is important for the rehabilitative user is important for the older exerciser as well.

The setting of air pressure in the pneumatic system will determine the amount of flex and the degree of energy expended to move the platform up and down. The pneumatic exerciser is designed primarily for building leg strength and rehabilitating the muscles and tendons of the foot, ankle, knee and upper leg. With more vigorous motion cardiopulmonary benefits are also realized. Of course, it can also be used for pleasurable exercise by anyone wishing to experience the motion of the trampoline without the dangers of using a trampoline without spotters. The user may also experience the same motion as jumping rope if he or she jumps on the platform instead of moving it solely by means of a flexing motion.

FIG. 8 is an example of a pressure set-up table such as will be included with each pneumatic exerciser 20. The format is a matrix of entries representing the pressure setting in PSIG (as read on pressure gauge 47) for a user of a particular weight in pounds desiring a particular bouncing frequency such as 1.5, 2.0, or 3.0 Hz as noted by the column headings. It has been found that the most desirable bouncing frequencies for the target market for the instant invention lie between 1.5 and 3 Hz (90 to 180 cpm; cycles per minute) although the device can be tuned for other frequencies outside of this range.

The 200 pound (91 kg) row was empirically derived from the prototype while the other entries were estimated using a quadratic regression formula relating pressure to spring constant. For actual production units, an extended chart of this type would be derived empirically for each entry, assuming the user is not standing on the platform 21 while using the pump or bleeding air from the system. This "unloaded pressure" would be entered on the chart. Since the relief vlave 61 is accessible to the user while on the platform, suitable adjustments can be made during use. Note that for a given desired frequency, a lighter person would use less system pressure. For a specific weight, lower frequency requires lower pressure. To achieve very low frequencies at some low pressure settings, the air spring 44 could bottom out if robust jumping activity is attempted. The limit stops built into the wheel assemblies will prevent this from happening by restraining the wheels. The low settings are quite usable for restricted low amplitude motion by the user.

Because the relationship of height to enclosed volume of the air spring is not linearly related as in a standard pneumatic cylinder, some of the relationships and formulas are rather complex and do not apply to both small perturbations as for vibration isolation as well as large amplitude applications as for this invention. The actual enclosed volume would be an empiracally derived table look-up based on height and pressure (which causes the bellows to stretch). The dynamic spring rate formula noted on page 22 of EDMG 197 is based on an adiabatic compression model and applies only to low amplitude perturbations. However, the formula presented for Fn, the natural frequency, is the standard relation for harmonic motion:

$$Fn = 188\sqrt{K/L}$$

where Fn is the natural frequency in cycles per minute (cpm), K is the effective spring rate of the air spring in lbs/in and L is the load in pounds.

A lower K will create a lower natural frequency for a given load. Using the published "Dynamic Characteristics" at 40 PSIG for the model 25 Airstroke® unit a spring rate of 329 lbs/in is given. Although this does not actually apply to large amplitude applications, the natural frequency for a 150 pound user (with a 20 pound sprung weight deficit) would be:

$$Fn = 188\sqrt{329/(150+20)} = 262 \text{ cpm} = 4.35 \text{ Hz}$$

This is based on the use of the internal volume of the bellows only. To lower the natural frequency, an air chamber is recommended. As a guideline to the size of the desired air chamber, a calculation based on the use of an adiabatic compression model was performed with several simplifying assumptions. The calculation is a static one comparing the compression of the bellows without an air chamber to that of a bellows with a 200 cubic inch air chamber with a starting pressure of 10 PSIG and a given suspended weight of 200 pounds. The "Force Table" of EDMG 197 for 20 PSIG for the model 25 Airstoke® unit varies from 240 to 360 pounds which translates into an effective "piston area" of an equivalent air cylinder of 12 to 18 square inches depending on bellows height. For simplification a 15 square inch area is assumed. If the starting volume of the bellows is 75 cubic inches, the height compression due to the load can be predicted using the formula:

$$P_1V_1^{\Gamma}=P_2V_2^{\Gamma}$$

where $P_1$ and $V_1$ represent the initial state and $P_2$ and $V_2$ represent the final state and 64 is the gas constant for air (1.38). $P_1$ is 10 PSIG which translates to 24.7 PSIA (10+14.7=24.7; pounds per square inch absolute) for the formula. $P_2$ is derived from 200 lbs/15 sq. in. or 13.3 PSIG which translates to 28 PSIA (13.3+14.7=28).

Without an air chamber, $V_2$ is calculated as follows:

$$24.7(75)^{1.38}=28(V_2)^{1.38};\ V_2=68.5 \text{ cu. in.}$$

By taking $(V_1-V_2)/15$ we can estimate a stroke of only 0.43 inches.

With the air chamber, $V_2$ is calculated as follows:

$$24.7(75+200)^{1.38}=28(V_2)^{1.38};\ V_2=251.1 \text{ cu. in.}$$

By taking $(V_1-V_2)/15$ the stroke is estimated as 1.6 inches. Since this is a stroke expansion of almost four times, the 200 cubic inch air chamber was considered a good starting point. Some abbreviated empirical testing regarding Fn has bourne out the use of this size air chamber for the pneumatic exerciser.

Figure 9:
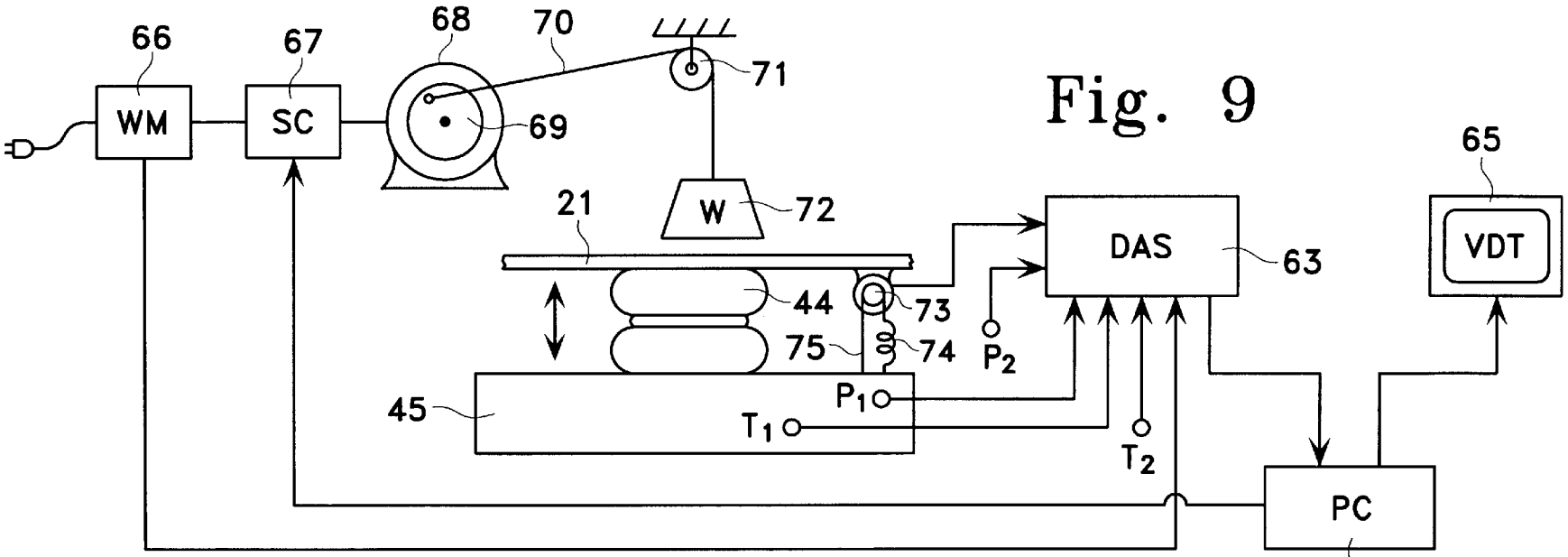
FIG. 9 is a block diagram of the energy characterization system.

FIG. 9 shows a system characterization installation for analyzing the performance of the pneumatic exerciser. A data acquisition system (DAS) 63 collects data from sensors and feeds them to a personal computer 64 having data analysis software. The results are displayed on a video display terminal 65. The usual computer devices such as keyboard, disk drives and mouse are also assumed to be present. An excitation subsystem consisting of wattmeter 66, speed controller 67, motor 68, pulley with crank pin 69, line 70, stationary pulley 71, and weight 72 is used to cyclically excite the pneumatic excerciser under test. The speed is controlled by the computer 64 while the wattmeter 66 is monitored through the DAS 63. The drive efficiency is well known and represented by tables or formulas in the computer 64 software.

The position of the platform 21 is monitored by a rotary incremental encoder 73 in conjunction with a spring 74 and bead chain 75. The air pressure P1 and air temperature T1 inside the air chamber 45 are monitored by sensors. The ambient temperature T2 and pressure P2 are monitored as well. The power input to the specific pneumatic exerciser under test is known by virtue of the wattmeter 66 readings and the efficiency information relating to the motor 68 and speed controller 67. The parameters of the pneumatic exerciser operation are known as well. Knowing the form of pneumatic loss mechanisms as well as frictional losses, some of the parameters can be combined into PV related psueudo parameters such as cycle stroke times maximum minus minimum cycle pressures.

The method is to study the best fit regression formulas of various types for predicting the cumulative input energy from pneumatic exerciser parameters. This should be done on a cycle by cycle basis. Real elapsed time as provided by the computer 64 is also available. The goal is to range the system starting pressure, the weight, and the excitation frequency to cover the entire parameter landscape of interest, and then to derive a minimum formula that is acurate to within 5% that hopefully will require only P1 and encoder 73 data; T1 can be added if required.

The pneumatic exerciser can be tuned such that the user will be able to bounce at an easily attainable system resonant frequency at which rather large amplitudes of vertical motion are achieved with a low power input. This should encourage a convalescing patient to prolong the low impact exercise since this can be done with little exertion. The spring action can be induced with short body motions without actually jumping. Therefore a user can start with very little exertion and build up to larger amplitudes or progress to higher frequencies and larger amplitudes which would require more physical exertion. Using a pneumatic system or air spring device with its characteristic nonlinear behavior results in a system with adjustable broad resonant peaks, i.e.—a low "Q" system ("quality factor" characteristic of resonance systems), so that adjustment is not critical and is easily achieved by the user.

By instrumenting the pneumatic exerciser at time of manufacture, analyzing the results, and deriving mathematical regression models, a simple ergometer can be specifically devised. This can be used to chart exercise performance and accurately determine any changes in exerciser tolerance.

Figure 10:
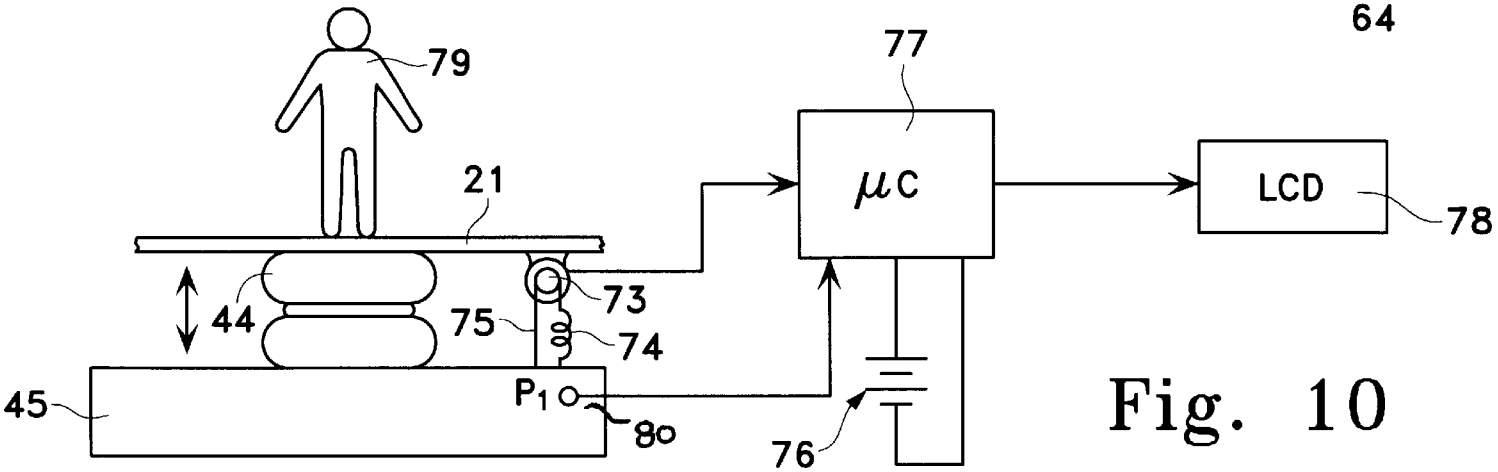
FIG. 10 is a block diagram of the ergometer system.

Having the regression formula in hand, the simple ergometer using two or three sensors can be designed. FIG. 10 shows such an ergometer consisting of a battery 76 which powers a micro computer 77 displaying the accumulated "calories" on a liquid crystal display 78 while the user 79 bounces on the platform 21. The regression formula can be quite complex since high powered yet inexpensive micro computers 77 are readily available. Only two sensors, encoder 73 and pressure transducer 80 are shown in FIG. 10. A temperature reading may also be necessary. The software within nonvolatile memory will acquire the sensor data and solve the regression formula on a cycle by cycle basis then accumulate the "calories" and periodically update the display 78.

The ergometer will accurately determine the energy put into the pneumatic exerciser by the user for use as a measure of his or her personal exertion. As the user's muscle tone and cardiovascular performance improve, the endurance should improve and be related to the output of the ergometer for a given heart rate. The question of "how many calories did I burn?" is not specifically addressed by the ergometer. That would require testing of the human subject as is often done in sports medicine and training to determine the metabolic rate of the particular athlete.

A variety of materials choices is available in the construction of the pneumatic exerciser. Steel or aluminum weldments can be used to construct the support system 22, but a molded or fabricated construction using fiber reinforced resin members can also be used and will reduce the weight of the apparatus. The platform 21 may be constructed of a rigid lightweight material such as plywood, composite, or molded panels. Materials used in the airframe industry such as aluminum skins adhesively bonded to a balsa wood core; a composite panel using Nomex®, a Du Pont aramid fiber; or a honeycomb core with aluminum skins which will function well due to its stiffness to weight ratio should also be considered, but their expense may not be justified for this application. The uprights 35 and crossbar 39 can be constructed of metal or fiber reinforced plastic tubing.

Since the handlebar assembly can be removed from the platform, the base unit can be turned on its side and transported on a small dolly and stored in a narrow space. Transporting wheels can also be affixed to the sides of the platform and sub base so the unit can be moved and stored without additional apparatus. Channels for placement of the handlebar assembly during storage can also be added to the system.

While one embodiment of the present invention has been illustrated and described in detail, it is to be understood that this invention is not limited thereto and may be otherwise practiced within the scope of the following claims.

I claim:

1. A low impact exercise apparatus comprising:

a horizontal platform for supporting a user thereon;

a plurality of rigid support members, movably interconnected, for resting on a supporting surface and for supporting said platform, maintaining said platform in horizontal orientation, and enabling said platform to move vertically only;

handlebar assembly means attached to said platform, so as to always be at the same height in relation to the user, for providing upper body support to the user during the exercise period; and air spring means disposed beneath said platform and within said support means for providing smooth and controlled resistance and return for said platform in response to the vertical movement of said platform initiated by the user.

2. A low impact exercise apparatus as in claim 1 further comprising an air chamber in communication with the air spring means.

3. A low impact exercise apparatus as in claim 1 further comprising an air chamber in communication with the air spring means, a compressed air supply means for providing compressed air, a relief means for bleeding out excess air, air conduit means for enabling communication between the air chamber, the compressed air supply means and the relief means, and a pressure gauge means for reading the pressure of the compressed air and thereby assisting the user in adjusting the pressure to best serve his or her exercise needs.

4. A low impact exercise apparatus comprising:

a horizontal platform for supporting a user thereon;

a plurality of rigid support members, movably interconnected, for resting on a supporting surface and for supporting said platform, maintaining said platform in horizontal orientation, and enabling said platform to move vertically only;

handlebar assembly means attached to said platform, so as to always be at the same height in relation to the user, for providing upper body support to the user during the exercise period; and pneumatic spring assembly means disposed beneath said platform and within said support means for providing smooth and controlled resistance and return for said platform in response to a movement of said platform initiated by the user, said pneumatic spring assembly means comprising an air spring, an air chamber in communication with the air spring, compressed air supply means for providing compressed air, relief means for bleeding out excess air, and air conduit means for enabling communication between the air chamber, the compressed air supply means and the relief means.

5. A low impact exercise apparatus as in claim 4 further comprising pressure gauge means for reading the pressure of the compressed air within the pneumatic spring assembly means and thereby assisting the user in adjusting the pressure within the pneumatic spring assembly means to best serve his or her exercise needs.

6. A low impact exercise apparatus comprising:

a horizontal platform having an upper surface and a lower surface, for supporting a user thereon, said platform being constrained to move vertically only;

support means for resting on a supporting surface, supporting said platform, and maintaining said platform in horizontal orientation, said support means including pivotally connected rigid crossed members which enable said platform to move vertically;

handlebar assembly means removably attached to the upper surface of said platform for providing upper body support to the user and being vertically adjustable to accommodate the specific support needs of the user; and pneumatic spring assembly means disposed beneath said platform and within said support means for providing smooth and controlled resistance and return for said platform in response to a movement of said platform initiated by the user, said pneumatic spring assembly means comprising an air spring affixed to the lower surface of said platform, an air chamber means situated beneath said air spring, attached thereto and in communication therewith, for lowering the natural resonance frequency thereof, compressed air supply means for providing compressed air, relief means for bleeding out excess air, pressure gauge means for reading the pressure of the compressed air and thereby assisting the user in adjusting the pressure and therewith the resistance and bouncing frequency within the pneumatic spring assembly means to best serve his or her exercise needs, and air conduit means for enabling communication between the air chamber means, the compressed air supply means, the relief means and the pressure gauge means.

7. A low impact exercise apparatus as in claim 6 further comprising wheel assembly means affixed to an end of each crossed member for providing smooth vertical movement of said platform.

8. A low impact exercise apparatus as in claim 6 further comprising limit stop means for preventing said air spring from being compressed beyond its lower design limit or from being stretched beyond its stretch limit.

9. A low impact exercise apparatus as in claim 6 wherein the air spring comprises a two convolution reinforced rubber bellows.

10. A low impact exercise apparatus as in claim 9 wherein the air spring has a minimum height of 2.8 inches (7.1 cm) and a maximum height of 7 inches (17.8 cm) and is capable of use with air pressures up to 100 PSIG.

11. A low impact exercise apparatus as in claim 10 wherein the air spring is a model 25 Airstroke® Actuator.

12. A low impact exercise apparatus as in claim 6 wherein the compressed air supply means is a pump such that when the user activates the pump compressed air is released into the pneumatic spring assembly means thereby increasing the resistance and causing the user to expend more energy to move the platform vertically.

13. A low impact exercise apparatus as in claim 6 wherein the compressed air supply means is a foot operated tire pump.

14. A low impact exercise apparatus as in claim 6 further comprising an ergometer for determination of the energy expended by the user during an exercise period.

15. A low impact exercise apparatus as in claim 6 further comprising a pressure set-up table to enable the user to set the pressure within the pneumatic spring assembly means at a specified level to achieve a desired bouncing frequency.

16. A low impact exercise apparatus as in claim 6 wherein the air chamber means has a volume of 200 cubic inches.

17. A low impact exercise apparatus as in claim 6 in which the pneumatic spring assembly means further comprises a high quality check valve.

18. A low impact exercise apparatus as in claim 6 in which the pneumatic spring assembly means further comprises a Schraeder valve.

19. A low impact exercise apparatus as in claim 6 in which the pneumatic spring assembly means further comprises a T-coupling means for enabling compressed air to enter the air chamber means and to reach the pressure gauge means at the same time.

* * * * *